United States Patent [19]

Eckert

[11] 4,134,787

[45] Jan. 16, 1979

[54] DELIGNIFICATION OF LIGNOCELLULOSIC MATERIAL WITH AN ALKALINE LIQUOR CONTAINING A CYCLIC AMINO COMPOUND

[75] Inventor: Robert C. Eckert, Kent, Wash.

[73] Assignee: International Paper Company, New York, N.Y.

[21] Appl. No.: 910,164

[22] Filed: May 26, 1978

[51] Int. Cl.[2] ..... D21C 3/02; D21C 3/20

[52] U.S. Cl. ..... 162/72; 162/90

[58] Field of Search ..... 162/72, 60, 90; 8/189; 544/347, 353

[56] References Cited

U.S. PATENT DOCUMENTS

| | | | |
|---|---|---|---|
| 2,068,151 | 1/1937 | Remlar | 162/72 |
| 2,813,868 | 11/1957 | König | 544/347 |
| 3,236,850 | 2/1966 | Oswald et al. | 544/347 |
| 4,012,280 | 3/1977 | Holton | 162/90 |

FOREIGN PATENT DOCUMENTS

| | | | |
|---|---|---|---|
| 98549 | 6/1973 | German Democratic Rep. | 162/72 |

OTHER PUBLICATIONS

Institute Paper Chemistry Abstract Bulletin, vol. 39, No. 9 (Mar. 1969), Abstract #7327.

Takagi et al., Starke 20, No. 8 pp. 251–256, (8–1968), "Determination of Carbonyl Groups In Starches . . ."

*Primary Examiner*—S. Leon Bashore

*Assistant Examiner*—Steve Alvo

*Attorney, Agent, or Firm*—Jay S. Cinamon

[57] ABSTRACT

A process for the delignification of a lignocellulosic material, which comprises the steps of: (a) digesting the lignocellulosic material with an aqueous, alkaline pulping liquor containing from about 0.1% to about 10% based on the weight of oven-dried lignocellulosic material, of a cyclic amino compound selected from the group consisting of phenazine, dihydrophenazine, quinoxaline, and their alkyl, alkoxy, hydroxy, carboxy and amino derivatives at a temperature of from about 150° C. to about 200° C. for a period of from about 5 to about 480 minutes; and then (b) removing the aqueous pulping liquor from the lignocellulosic material with water or an aqueous wash liquor inert to the lignocellulosic material to obtain a delignified cellulosic material.

8 Claims, No Drawings

DELIGNIFICATION OF LIGNOCELLULOSIC MATERIAL WITH AN ALKALINE LIQUOR CONTAINING A CYCLIC AMINO COMPOUND

BACKGROUND OF THE INVENTION

1. Field of the Invention

The present invention relates to a process for delignifying lignocellulosic pulps and, more particularly, to a process for accelerating or catalyzing the alkaline cooking of lignocellulosic pulps.

2. Description of the Prior Art

The major alkaline pulping processes for the manufacture of chemical pulps are the soda process, and the sulfate or kraft process. Over the years various modifications and improvements to these basic alkaline processes have been described in the patent and technical literature. These improvements have variously addressed themselves to increasing yield, abating pollution and increasing the rate and extent of delignification. In line with the foregoing, there have been a number of publications which have dealt with accelerating these alkaline pulping processes.

Remler, U.S. Pat. No. 2,068,151, discloses that the alkaline cooking of fibrous materials, such as straw, grass, corn stalks, bagasse and wood chips excluding resinous woods, can be materially shortened by the addition of a small amount of an introfier, for example, turpentine, aniline, or pyridine, to the alkaline cooking medium. More recently, Bach and Fiehn disclosed in East German Pat. No. 98,549 that the pulp yields obtainable from the soda process can be enhanced by the addition to the pulping liquor of small quantities of anthraquinone-2-monosulphonic acid. Most recently, in 1977, Holton disclosed, in U.S. Pat. No. 4,012,280, that the addition of anthraquinone, and certain of its derivatives, to a soda or a kraft cook serves to increase the yield and the rate of delignification, and when used in the soda process also maintains the system free of any objectionable sulfur compounds.

SUMMARY OF THE INVENTION

A process has been discovered for the delignification of lignocellulosic materials, which comprises the steps of: (a) digesting a lignocellulosic material with an alkaline cooking liquor in the presence of from about 0.1 to about 10%, by weight of oven-dried lignocellulosic material, of a cyclic amino compound selected from the group consisting of phenazine, dihydrophenazine, quinoxaline and their alkyl, alkoxy, hydroxy, carboxy and amino derivatives at a temperature of from about 150° C. to about 200° C. for a period of from about 10 minutes to about 360 minutes; and then (b) displacing the spent pulping liquour with water or an aqueous wash liquor inert to the lignocellulosic material to obtain a delignified cellulosic material.

When the present invention is practiced with a soda cooking liquour, the delignification rate and pulp yield is, quite surprisingly, similar to that obtainable by a kraft cook, and the pulp quality is equivalent to that of a kraft pulp. A further advantage attendant a soda cook in accordance with the present invention is the elimination of malodorous sulfur compounds since the cyclic amino additives of the present invention are free of the sulfur which has characterized many pulping additives, for example, polysulfide, disclosed by the prior art. While the benefits obtained from the present invention when employed in a kraft cook are not as marked as is the case with a soda cook, an increase in the rate of delignification is achieved as evidenced by a decrease in Kappa number.

DETAILED DESCRIPTION OF THE INVENTION

The lignocellulosic materials used in the pulping process of the present invention can be either softwoods or hardwoods, or other varieties of fibrous, nonwoody lignocellulosic material, for example, bagasse. They can be employed in the form of chips, wafers, slivers, etc.

The lignocellulosic material is placed in a pressure vessel, i.e., a closed reaction vessel or digester, to which is added an alkaline pulping liquor containing a cyclic amino compound selected from the group consisting of phenazine, dihydrophenazine, quinoxaline and their alkyl, alkoxy, hydroxy, carboxy and amino derivatives. The reaction, i.e., digestion, is conducted at a temperature within the range of from about 150° C. to about 200° C., with a preferred temperature within the range of from about 160° C. to about 180° C., and for a period of time of from about 10 minutes to about 360 minutes.

The alkaline pulping liquor can be a soda liquor, a kraft white liquor, or a kraft green liquor. When the alkaline pulping liquor is a soda liquor it should contain from about 5% to about 30% of an alkali metal hydroxide, e.g., sodium hydroxide, expressed as active alkali equivalents of sodium oxide, based on the weight of the lignocellulosic material. Sometimes the soda liquor also contains an alkali metal carbonate, e.g., sodium carbonate.

When a kraft white liquor is used as the alkaline pulping liquor, it should contain from about 5% to about 25%, by weight of active alkali equivalents of sodium oxide, based on the weight of the lignocellulosic material. The sulfidity of the kraft white liquor is about 5% to about 40%, based on the active alkali content of the liquor.

When the alkaline pulping liquor employed in the present invention is a kraft green liquor, it consists primarily of alkali metal sulfide, e.g., sodium sulfide, and alkali metal carbonate, e.g., sodium carbonate, with minor amounts of an alkali metal hydroxide, e.g., sodium hydroxide, and contains from about 5% to about 30%, by weight of active alkali equivalents of sodium oxide, based on the weight of lignocellulosic material. The kraft green liquor has a sulfidity of about 5% to about 100%, based on the total alkali content of the liquor.

The amount of the cyclic amino compound present in the alkaline pulping liquor can be from about 0.1% to about 10%, by weight, based on the oven-dried weight of the lignocellulosic material employed. It is preferred, however, to employ from about 0.5% to about 1.0%, based on the oven-dried weight of lignocellulosic material. The preferred class of cyclic amino compounds are phenazine and the alkyl and alkoxy derivatives of phenazine containing from 1 to 4 carbon atoms.

After completion of the digestion with pulping liquor, the partially delignified material is discharged from the reactor and the spent pulping liquor is displaced from the insoluble lignocellulosic material by washing with water or other suitable aqueous wash liquor inert to the lignocellulosic material to obtain a delignified cellulosic material.

The partially delignified pulp may then be bleached in accordance with any of the well-known conventional bleaching sequences.

In order to disclose more clearly the nature of the present invention, the following examples illustrating the invention are given. It should be understood, however, that this is done solely by way of example and is intended neither to delineate the scope of the invention nor limit the ambit of the appended claims.

EXAMPLE 1

A series of six (6) soda cooks were made in a six liter M&K digester using 515 grams, on an oven-dried (O.D.) basis, of white pine chips. The soda cooks were all made with 22% sodium hydroxide on O.D. wood, the sodium hydroxide being added to the digester to give a 17% active alkali charge, as $Na_2O$, based on the oven-dried weight of the chips and a 4:1 liquor to wood (L:W) ratio. In each cook the heat-up time was 70 minutes from 100° C. to a maximum temperature of 170° C. The time at the maximum temperature varied, as indicated in Table 1 below.

After completion of the cooking, the cooking liquor was blown from the digester and the chips were removed. The chips were then broken up in a British disintegrator and the pulp was washed in a screenbox with large quantities of water. The pulp was then centrifuged to remove excess water and the yield and Kappa number were determined. The Kappa number was determined in accordance with TAPPI Method T-236 M-60.

TABLE I

| Cook Number | 1 | 2 | 3 | 4 | 5 | 6 |
|---|---|---|---|---|---|---|
| Phenazine Added, % on O.D. Wood | 0 | 0.25 | 0.50 | 1.0 | 0 | 0.87 |
| Time at 170° C., hr | 2.0 | 2.0 | 2.0 | 2.0 | 1.0 | 1.0 |
| Total Pulp Yield, % on O.D. Wood | 46.2 | 41.6 | 44.8 | 44.1 | 52.9 | 43.6 |
| Kappa Number | 76 | 46 | 31 | 31 | 125 | 45 |
| Rejects, % | 2.7 | 0.8 | 2.3 | 0.8 | 82.1 | 5.1 |

It is readily evident from an examination of Table I, that compared to conventional soda pulping the present invention provides more rapid delignification kinetics and improved pulp quality.

EXAMPLE 2

To demonstrate the process of the present invention, soda cooks were made with and without quinoxaline. The cooks were made in a six liter M&K digester using 515 grams, on an ovendried basis, of white pine chips. The soda cooks were all made with 22% sodium hydroxide on O.D. wood, the sodium hydroxide being added to the digester to give a 17% active alkali charge, as $Na_2O$, based on the oven-dried weight of the chips and a 4:1 liquor to wood (L:W) ratio. In each cook the heat-up time was 70 minutes from 100° C. to a maximum temperature of 170° C.

The same washing sequence that was employed in Example 1 was followed in this example.

TABLE II

| Cook Number | 1 | 2 |
|---|---|---|
| Quinoxaline Added, % on O.D. Wood | 0 | 0.63 |
| Time at 170° C., hr | 2.0 | 2.0 |
| Total Pulp Yield, % on O.D. Wood | 46.2 | 46.7 |
| Kappa Number | 76 | 59 |
| Rejects, % | 2.7 | 2.0 |

EXAMPLE 3

Two kraft cooks were made, with and without phenazine, in a six liter M&K digester using southern pine chips. Sodium hydroxide and sodium sulfide were added to the digester to give a 13.5% active alkali charge, as $Na_2O$, based on the oven-dried weight of the chips and a 4:1 liquor to wood ratio. The sulfidity of the liquor was 22%, based on the active alkali content of the liquor. In each cook, heat-up time was 70 minutes from 100° C. to a maximum temperature of 170° C. The pulping results are given below in Table III.

The same washing sequence that was employed in Example 1 was followed in this example.

TABLE III

| Cook Number | 1 | 2 |
|---|---|---|
| Phenazine Added, % on O.D. Wood | 0 | 0.5 |
| Time at 170° C., minutes | 45 | 45 |
| Total Pulp Yield, % on O.D. Wood | 61.1 | 60.4 |
| Kappa Number | 94 | 85 |

What is claimed is:

1. A process for the delignification of a lignocellulosic material, which comprises the steps of:
   (a) digesting the lignocellulosic material with an aqueous, alkaline pulping liquor containing from about 0.1% to about 10% based on the weight of oven-dried lignocellulosic material, of a cyclic amino compound selected from the group consisting of phenazine, dihydrophenazine, quinoxaline, and their alkyl, alkoxy, hydroxy, carboxy and amino derivatives at a temperature of from about 150° C. to about 200° C. for a period of from about 5 to about 480 minutes; and then
   (b) removing the aqueous pulping liquor from the lignocellulosic material with water or an aqueous wash liquor inert to the lignocellulosic material to obtain a delignified cellulosic material.

2. A process according to claim 1 wherein the cyclic amino compound is phenazine.

3. A process according to claim 1 wherein the cyclic amino compound is selected from the group consisting of alkyl and alkoxy derivatives of phenazine containing from 1 to 4 carbon atoms.

4. A process according to claim 1 wherein the cyclic amino compound is quinoxaline.

5. A process according to claim 1 wherein the alkaline pulping liquor contains from about 0.5% to about 1.0% based on the weight of oven-dried lignocellulosic material, of the cyclic amino compound.

6. A process according to claim 1 wherein the alkaline pulping liquor is a soda liquor.

7. A process according to claim 1 wherein the alkaline pulping liquor is a kraft liquor.

8. A process for the delignification of lignocellulosic material which comprises the steps of:
   (a) digesting a lignocellulosic material with a soda liquor containing from about 0.5% to about 1% based on the weight of oven-dried lignocellulosic material, of phenazine in a closed reaction vessel at a temperature of from about 150° C. to about 200° C. for a period of from about 10 minutes to about 360 minutes; and then
   (b) removing the aqueous pulping liquor from the lignocellulosic material with water or an aqueous wash liquor inert to the lignocellulosic material to obtain a delignified cellulosic material.

* * * * *